US008934657B2

(12) United States Patent
Wilk

(10) Patent No.: US 8,934,657 B2
(45) Date of Patent: Jan. 13, 2015

(54) SPEAKER MAGNET ASSEMBLY WITH INCLUDED SPIDER

(71) Applicant: Apple Inc., Cupertino, CA (US)

(72) Inventor: Christopher Wilk, Los Gatos, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 13/762,259

(22) Filed: Feb. 7, 2013

(65) Prior Publication Data

US 2014/0219479 A1 Aug. 7, 2014

(51) Int. Cl.
*H04R 1/00* (2006.01)
*H04R 15/00* (2006.01)

(52) U.S. Cl.
CPC ..... *H04R 15/00* (2013.01)
USPC ..... 381/404

(58) Field of Classification Search
USPC ..... 381/404
See application file for complete search history.

(56) References Cited

U.S. PATENT DOCUMENTS

| | | | | |
|---|---|---|---|---|
| 5,848,174 | A | 12/1998 | Ki et al. | |
| 6,222,931 | B1 | 4/2001 | Cesati | |
| 6,778,677 | B2 * | 8/2004 | Coffin | 381/418 |
| 8,290,199 | B2 * | 10/2012 | Pircaro | 381/398 |
| 8,290,201 | B2 | 10/2012 | Kamimura et al. | |
| 2005/0117772 | A1 | 6/2005 | Chang | |
| 2010/0046788 | A1 | 2/2010 | Harris et al. | |
| 2010/0296689 | A1 | 11/2010 | Pircaro | |
| 2013/0114846 | A1 * | 5/2013 | Flavignard et al. | 381/400 |
| 2014/0072163 | A1 * | 3/2014 | Yamada | 381/354 |

FOREIGN PATENT DOCUMENTS

| | | |
|---|---|---|
| DE | 202004014927 | 2/2005 |
| FR | 2866777 | 8/2005 |
| GB | 451178 | 1/1935 |
| JP | 5745798 | 3/1982 |
| WO | WO 2007/042032 A2 | 4/2007 |

OTHER PUBLICATIONS

International Search Report and the Written Opinion of the International Searching Authority, for corresponding International Application No. PCT/US2014/011854, mailing date of Apr. 22, 2014, 10 pages.

* cited by examiner

*Primary Examiner* — Davetta W. Goins
*Assistant Examiner* — Amir Etesam
(74) *Attorney, Agent, or Firm* — Blakely, Sokoloff, Taylor & Zafman LLP

(57) ABSTRACT

A magnet assembly for a audio speaker provides a gap through which a voice coil assembly passes. A magnetic member, a yoke, and a pole piece form a magnetic circuit that focuses magnetic energy in the gap. A spider movably supports the voice coil assembly. The spider is coupled to one of the magnetic member or the yoke by forming the one of the magnetic member or the yoke in two parts and joining the two parts with a portion of the spider between the two parts. The spider may be formed from a thin film thermoplastic, such as polyetheretherketone (PEEK), and may be less than 10 microns thick. The portion of the spider that is between the two parts may be shaped such that a portion of the two parts are in direct contact with one another.

12 Claims, 3 Drawing Sheets

SPEAKER MAGNET ASSEMBLY WITH INCLUDED SPIDER

BACKGROUND

1. Field

Embodiments of the invention relate to the field of electromagnetic audio speakers; and more specifically, to spiders for use in compact audio speakers.

2. Background

Audio speakers use electrical signals to produce air pressure waves which are perceived as sounds. Many audio speakers use a diaphragm that is movably suspended in a frame by a surround. The diaphragm is coupled to a voice coil assembly that is suspended in a magnetic field. The electrical signals representing the sound flow through the voice coil and interact with the magnetic field. This causes the voice coil and the coupled diaphragm to oscillate in response to the electrical signal. The oscillation of the diaphragm produces air pressure waves.

It is desirable to provide an additional support for the diaphragm and voice coil assembly using a spider. The spider readily flexes in the direction of motion of the diaphragm, but resists motion perpendicular to the diaphragm's motion. The spider surrounds the voice coil assembly in an annular manner.

It is desirable for the spider to be spaced at a distance from the surround to improve the resistance to perpendicular motion. The magnet assembly that provides the magnetic field in which the voice coil assembly is suspended is typically the part of the speaker that is furthest from the surround. The spider is typically attached to the speaker frame above the magnet assembly placing it closer to the surround than the magnet assembly.

Speakers used in compact, portable devices often need to be thin. This requires a construction that reduces the distance between the surround and the magnet assembly. This can make it difficult to attach the spider at a sufficient distance from the surround to effective resist perpendicular motion of the diaphragm and voice coil assembly.

Thus it would be desirable to provide audio speaker that is thin while having a spider attached at a sufficient distance from the surround to effectively resist perpendicular motion of the diaphragm and voice coil assembly.

SUMMARY

A magnet assembly for a audio speaker provides a gap through which a voice coil assembly passes. A magnetic member, a pole piece, and a yoke form a magnetic circuit that focuses magnetic energy in the gap. A spider movably supports the voice coil assembly. The spider is coupled to one of the magnetic member or the yoke by forming the one of the magnetic member or the yoke in two parts and joining the two parts with a portion of the spider between the two parts. The spider may be formed from a thin film thermoplastic, such as polyetheretherketone, and may be less than 10 microns thick. The portion of the spider that is between the two parts may be shaped such that a portion of the two parts are in direct contact with one another.

Other features and advantages of the present invention will be apparent from the accompanying drawings and from the detailed description that follows below.

BRIEF DESCRIPTION OF THE DRAWINGS

The invention may best be understood by referring to the following description and accompanying drawings that are used to illustrate embodiments of the invention by way of example and not limitation. In the drawings, in which like reference numerals indicate similar elements.

DETAILED DESCRIPTION

In the following description, numerous specific details are set forth. However, it is understood that embodiments of the invention may be practiced without these specific details. In other instances, well-known circuits, structures and techniques have not been shown in detail in order not to obscure the understanding of this description.

Figure 1:
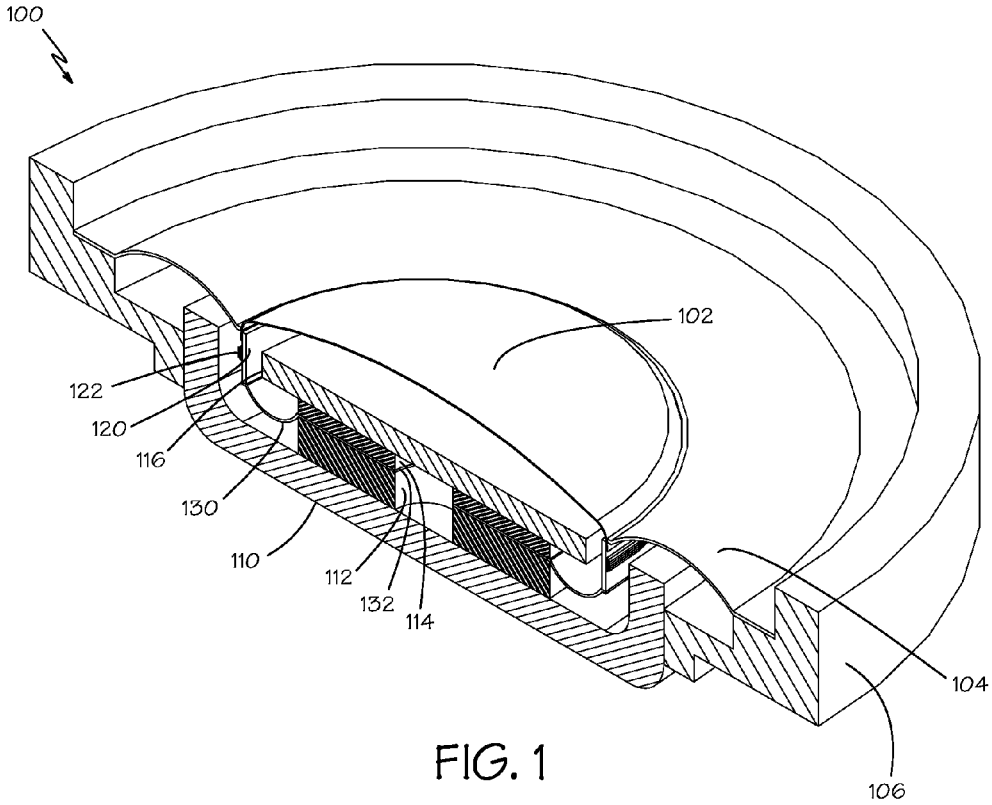
FIG. 1 is a pictorial view of an audio speaker that has been cut away along a diameter to allow the construction to be better seen.

FIG. 1 is a pictorial view of an audio speaker 100 that has been cut away along a diameter to allow the construction to be better seen. A diaphragm 102 is coupled to a frame 106 by a surround 104 that readily flexes to allow the diaphragm to move freely along an axis that is perpendicular to the face of the diaphragm.

Figure 2:
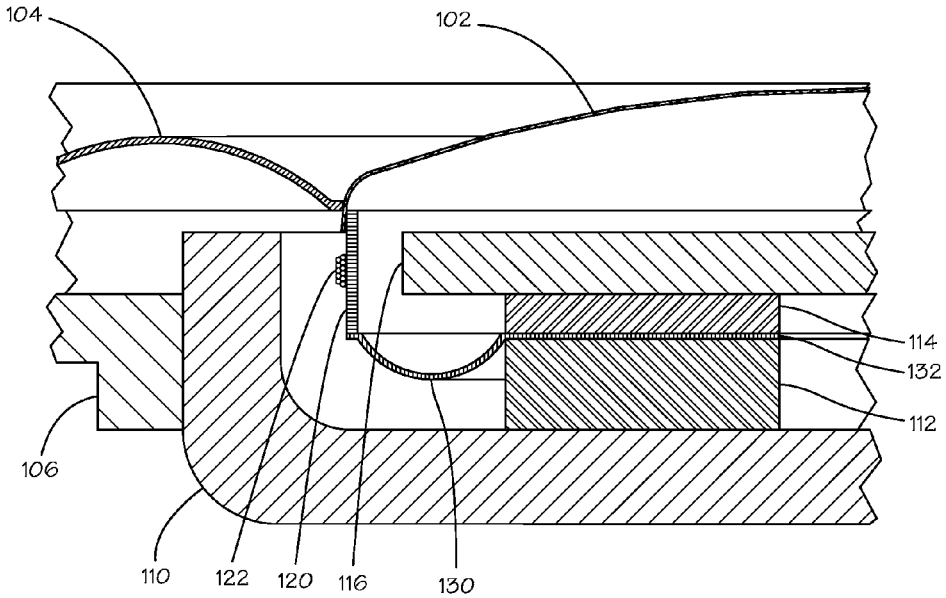
FIG. 2 is a cross-section of a portion of a magnet assembly shown in FIG. 1.

FIG. 2 is a cross-section of a portion of a magnet assembly shown in FIG. 1. The magnet assembly includes a magnetic member 112, 114, a yoke 110 magnetically coupled to the magnetic member, and a pole piece 116 magnetically coupled to the magnetic member. The pole piece forms one side of a gap through which a voice coil assembly 120, 122 passes. The magnetic member 112, 114, the yoke 110, and the pole piece 116 form a magnetic circuit that focuses magnetic energy in the gap.

A spider 130 is coupled to the magnetic member by forming the magnetic member in a first part 112 and a second part 114 and joining the two parts with a portion 132 of the spider between the two parts. It will be appreciated that creating an additional gap in the magnetic circuit degrades the circuit. The spider 130 may be formed from a thin film thermoplastic to minimize such degradation. For example, the thin film thermoplastic may have a thickness of less than 10 microns (0.010 mm, 0.0004 in.).

A magnet assembly may reach temperatures of about 100° Celsius (212° Fahrenheit) in operation. The thin film thermoplastic should have a glass transition temperature ($T_g$) substantially above the peak operating temperature of the magnet assembly, for example greater than 110° Celsius (230° Fahrenheit). The thin film thermoplastic may be polyetheretherketone (PEEK) which is strong, and heat-resistant having a glass transition temperature ($T_g$) of around 143° C. (289° F.).

The spider 130 provides a concentrically-waved film that couples the former 120 around which a voice coil 122 is wound to the magnet assembly. The concentrically-waved film of the spider 130 readily flexes in the direction of motion of the diaphragm 102, but resists motion perpendicular to the diaphragm's motion. The spider surrounds and is attached to the former 120 in an annular manner, such as by being adhesively joined.

Figure 3:
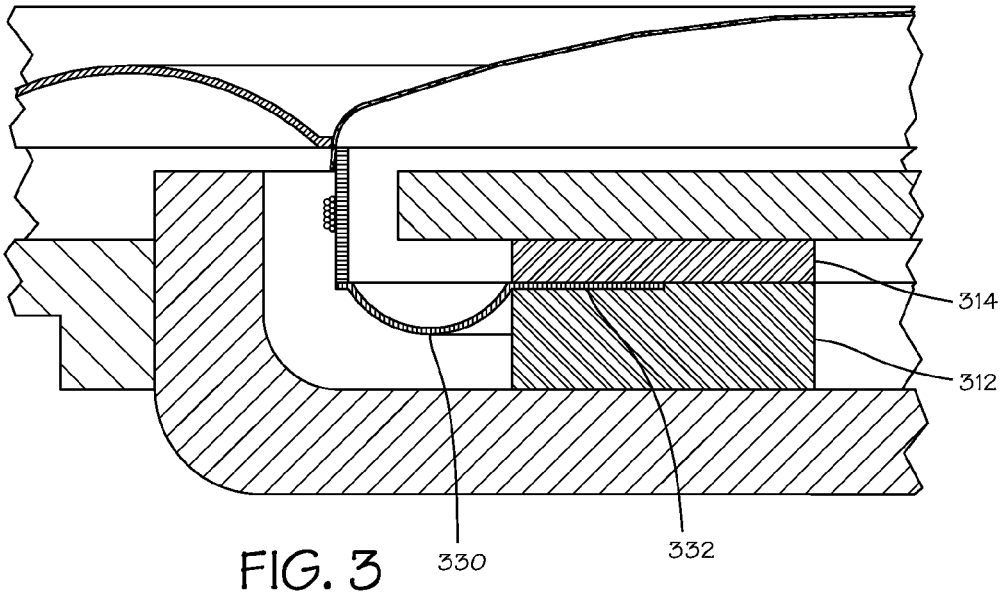
FIG. 3 is a cross-section of a portion of another magnet assembly.

FIG. 3 is a cross-section of a portion of another magnet assembly similar to the one shown in FIG. 2. In this assembly the portion 332 of the spider 330 that is between the two parts of the magnetic member 312, 314 is shaped such that an inner portion of one of the magnets 312 passes through the spider to directly contact the other magnet 314. The lessens the deleterious effects of the additional gap in the magnetic circuit that receives and supports a portion of the spider 330.

Figure 4:
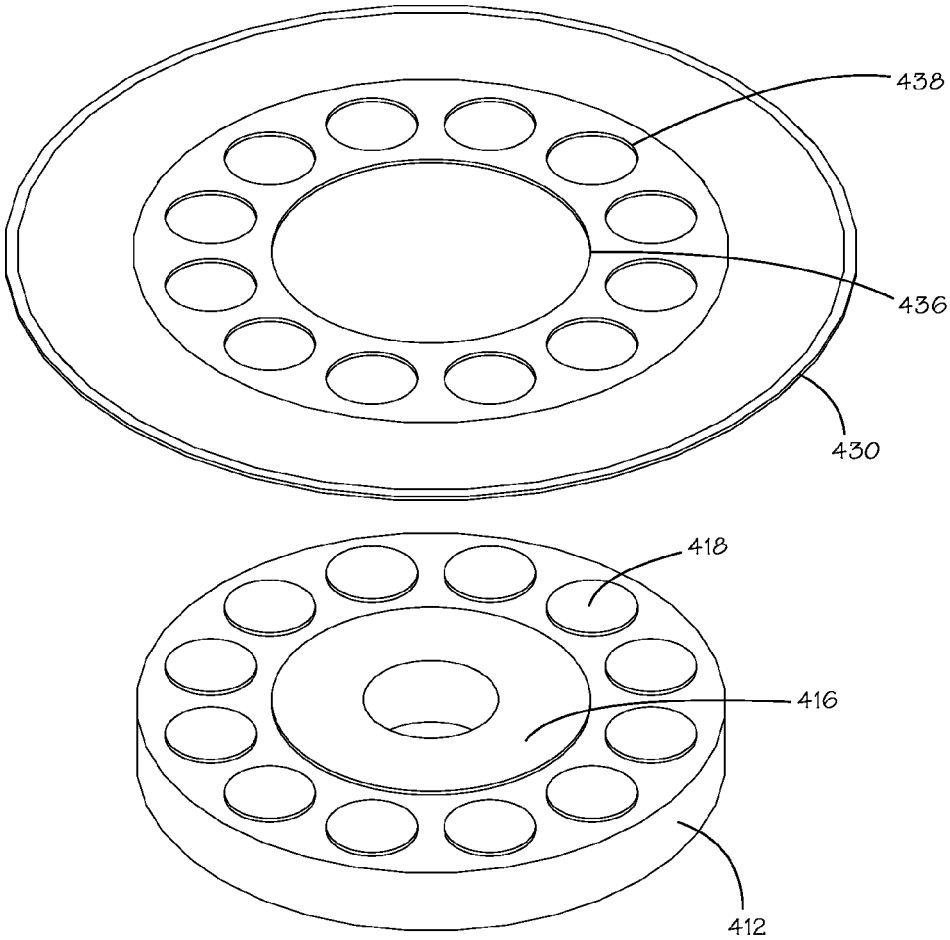
FIG. 4 is a pictorial view of another spider and one part of a magnetic member.

FIG. 4 is a pictorial view of another spider 430 and one part 414 of a magnetic member. The spider 430 includes a central opening 436 that is large enough to allow an inner portion 416 of the one magnet part 412 to pass through the spider to directly contact the other magnet part, as shown in FIG. 3. The spider 430 further includes peripheral openings 438 that allow projections 418 on the one magnet part 412 to pass through the spider to directly contact the other magnet part to further lessen the deleterious effects of the additional gap in the magnetic circuit. Other embodiments may provide only the peripheral openings, which may have different sizes, shapes, and/or positions and be of different numbers. Other embodiments may provide projections on both magnet parts and/or may provide recesses in one or both magnet parts to receive the projections.

Figure 5:
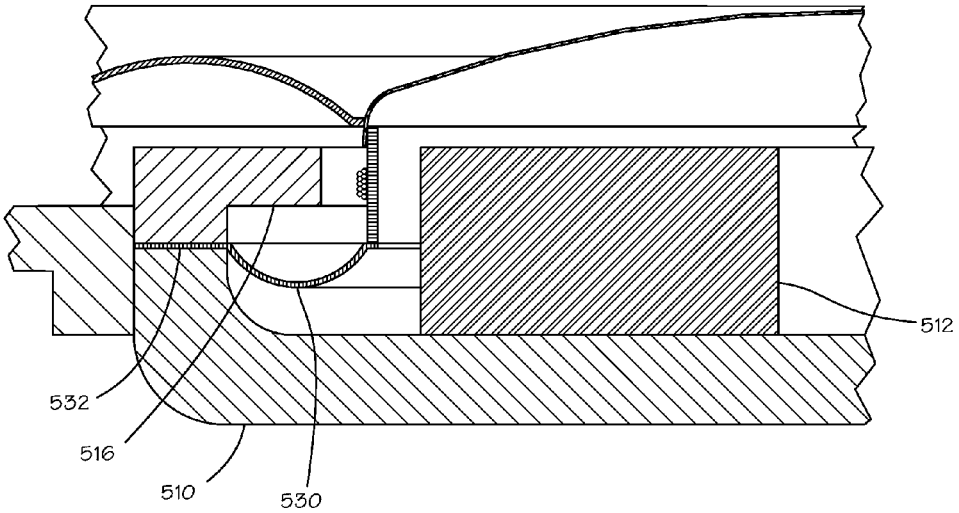
FIG. 5 is a cross-section of a portion of still another magnet assembly.

FIG. 5 is a cross-section of a portion of still another magnet assembly similar to the one shown in FIG. 3. In this assembly the magnetic member 512 is a single part. The yoke is formed of a first part 510 and a second part 516 that includes the pole piece. A portion 532 of the spider 530 is supported between the two parts.

Figure 6:
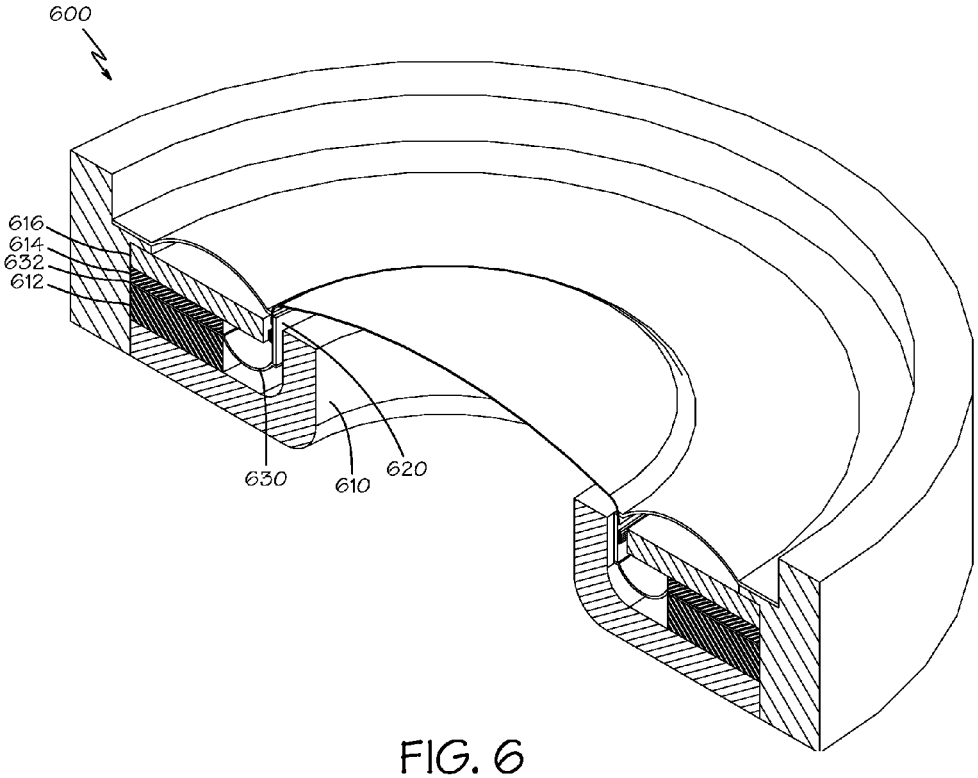
FIG. 6 is a pictorial view of another audio speaker that has been cut away along a diameter to allow the construction to be better seen.

FIG. 6 is a pictorial view of another audio speaker 600 that has been cut away along a diameter to allow the construction to be better seen. In this embodiment the magnetic member 612, 614 and the pole piece 616 are external to the voice coil assembly 620. The yoke 610 extends to the inside of the voice coil assembly 620 to complete the magnetic circuit and form one side of the gap. The spider 630 is coupled to the magnetic member by forming the magnetic member in a first part 612 and a second part 614 and joining the two parts with a portion 632 of the spider between the two parts.

While certain exemplary embodiments have been described and shown in the accompanying drawings, it is to be understood that such embodiments are merely illustrative of and not restrictive on the broad invention, and that this invention is not limited to the specific constructions and arrangements shown and described, since various other modifications may occur to those of ordinary skill in the art. For example, the acoustic speaker has been illustrated as being round but it may also be an oval, rectangle, or other shape. The spider has been shown with a single convolution but it may be provided with other patterns of convolutions. The spider may be formed of materials other than PEEK or thermoplastics. The description is thus to be regarded as illustrative instead of limiting.

What is claimed is:

1. A magnet assembly for an audio speaker, the magnet assembly comprising:

a magnetic member;

a yoke magnetically coupled to the magnetic member;

a pole piece magnetically coupled to the magnetic member and forming one side of a gap through which a voice coil assembly passes, the magnetic member, the yoke, and the pole piece forming a magnetic circuit that focuses magnetic energy in the gap; and a spider that is coupled to one of the magnetic member or the yoke by forming the one of the magnetic member or the yoke in two separable parts and joining the two separable parts with a portion of the spider between the two separable parts, the spider being formed from a thin film thermoplastic having a thickness of less than 10 microns (0.010 mm, 0.0004 in.).

2. The magnet assembly of claim 1 wherein the thin film thermoplastic has a glass transition temperature ($T_g$) of greater than 110 Celsius (230 Fahrenheit).

3. The magnet assembly of claim 1 wherein the thin film thermoplastic is polyetheretherketone (PEEK).

4. The magnet assembly of claim 1 wherein the portion of the spider that is between the two separable parts of the magnetic member or the yoke is shaped such that a portion of at least one of the two separable parts passes through the spider to directly contact the other of the two separable parts.

5. A method of assembling a magnet assembly for an audio speaker, the method comprising:

providing a magnetic member;

magnetically coupling a yoke to the magnetic member;

magnetically coupling a pole piece to the magnetic member to form a gap with the yoke through which a voice coil assembly passes, the magnetic member, the yoke, and the pole piece forming a magnetic circuit that focuses magnetic energy in the gap; and forming one of the magnetic member or the yoke in two separable parts;

providing a spider formed from a thin film thermoplastic having a thickness of less than 10 microns (0.010 mm, 0.0004 in.), and joining the two separable parts with a portion of the spider between the two separable parts.

6. The method of claim 5 wherein the thin film thermoplastic has a glass transition temperature ($T_g$) of greater than 110 Celsius (230 Fahrenheit).

7. The method of claim 5 wherein the thin film thermoplastic is polyetheretherketone (PEEK).

8. The method of claim 5 further comprising shaping the portion of the spider that is between the two separable parts of the magnetic member or the yoke such that a portion of at least one of the two separable parts passes through the spider to directly contact the other of the two separable parts.

9. A magnet assembly for an audio speaker comprising:

a magnetic member;

a yoke magnetically coupled to the magnetic member;

means for forming a gap in a magnetic circuit that focuses magnetic energy in the gap; and means for supporting a voice coil assembly that passes through the gap, the means being formed from a thin film thermoplastic having a thickness of less than 10 microns (0.010 mm, 0.0004 in.), the means being supported by one of the magnetic member or the yoke which is formed in two separable parts that are joined with a portion of the means between the two separable parts.

10. The magnet assembly of claim 9 wherein the thin film thermoplastic has a glass transition temperature ($T_g$) of greater than 110 Celsius (230 Fahrenheit).

11. The magnet assembly of claim 9 wherein the thin film thermoplastic is polyetheretherketone (PEEK).

12. The magnet assembly of claim 9 wherein shaping the portion of the means for supporting the voice coil assembly that is between the two separable parts of the magnetic member or the yoke is shaped such that a portion of at least one of the two separable parts passes through the means to directly contact the other of the two parts.

* * * * *